United States Patent [19]

Bizzell

[11] Patent Number: 4,520,865

[45] Date of Patent: Jun. 4, 1985

[54] GAS-TOLERANT ARTERIAL HEAT PIPE

[75] Inventor: Gary D. Bizzell, Los Altos, Calif.

[73] Assignee: Lockheed Missiles & Space Company, Inc., Sunnyvale, Calif.

[21] Appl. No.: 624,198

[22] Filed: Jun. 25, 1984

[51] Int. Cl.[3] ..... F28D 15/00

[52] U.S. Cl. ..... 165/104.26; 165/32; 165/104.27; 122/366

[58] Field of Search ..... 165/104.26, 96, 32, 165/104.27; 122/366

[56] References Cited

U.S. PATENT DOCUMENTS

| | | | |
|---|---|---|---|
| 3,517,730 | 6/1970 | Wyatt | 165/96 |
| 3,844,342 | 10/1974 | Eninger et al. | 165/104.26 |
| 4,441,548 | 4/1984 | Franklin et al. | 165/104.26 |
| 4,470,451 | 9/1984 | Alario et al. | 165/104.26 |

*Primary Examiner*—Albert W. Davis, Jr.
*Attorney, Agent, or Firm*—John J. Morrissey

[57] ABSTRACT

A closed-loop arterial heat pipe comprises an evaporator domain (10) and a condenser domain (11) interconnected by a transition domain (12). An interior surface of the evaporator domain (10) defines an evaporation chamber, which has a helical channel (17) of capillary transverse dimension formed thereon. The transition domain (11) defines a conduit (13) through which vapor-phase working fluid is thermodynamically driven substantially adiabatically from the evaporator domain (10) to the condenser domain (11), and an artery (14) through which liquid-phase working fluid is returned from the condenser domain (11) to the evaporator domain (10) by capillary action. The artery (14) has a generally pyriform transverse cross-sectional configuration that converges to a throat portion adjacent a slot (16) of capillary transverse dimension on the surface of the evaporation chamber. Whenever a gas bubble in the liquid-phase working fluid flowing in the artery (14) interrupts capillary pumping of the liquid-phase working fluid through the slot (16) into the evaporation chamber, heat conducted through the evaporator domain (10) to the artery (14) produces an increase in temperature in the liquid-phase working fluid adjacent the bubble. This increase in temperature vaporizes the liquid-phase working fluid between the bubble and the slot (16), and also raises the pressure in the bubble to a value approaching without exceeding the pressure in the evaporation chamber. As further heat is conducted to the artery (14), capillary pumping of the liquid-phase working fluid between the bubble and the slot (16) is restored, and the liquid-phase working fluid passes through the converging throat portion of the artery (14), and then through the slot (16), into the helical channel (17) on the surface defining the evaporation chamber. The bubble is then vented into the evaporation chamber, and capillary pumping of the liquid-phase working fluid from the artery (14) into the evaporation chamber resumes.

19 Claims, 7 Drawing Figures

GAS-TOLERANT ARTERIAL HEAT PIPE

TECHNICAL FIELD

This invention pertains generally to heat pipe technology, and more particularly to the venting of gas bubbles from the artery of an arterial heat pipe.

DESCRIPTION OF THE PRIOR ART

A closed-loop heat pipe for transporting a heat load from a heat source to a heat sink, where the heat source is at a higher temperature than the heat sink, conventionally comprises an evaporator configured for exposure to the heat source, a condenser configured for exposure to the heat sink, and a conduit structure interconnecting the evaporator and the condenser. A working fluid is made available in liquid phase within the evaporator to absorb heat from the heat source by evaporation. Due to the temperature difference between the heat source and the heat sink, the evaporated working fluid with its absorbed heat load is thermodynamically driven in vapor phase from the evaporator to the condenser via the interconnecting conduit structure substantially adiabatically. In the condenser, the vapor-phase working fluid rejects its heat load to the heat sink and thereby condenses to liquid phase. The condensed working fluid is then returned from the condenser through the conduit structure to the evaporator by capillary action. In the evaporator, the returned working fluid is again available in liquid phase for absorbing heat from the heat source by evaporation so that the heat-transport cycle can be repeated.

It is convenient to discuss the evaporator and the condenser of a closed-loop heat pipe as structurally distinct entities interconnected by the conduit structure. However, in principle, the evaporator and the condenser could be opposite end portions of an integral structure, in which case the evaporator would be that end portion in which evaporation of liquid-phase working fluid occurs, and the condenser would be that end portion in which condensation of vapor-phase working fluid occurs. More generally, therefore, a closed-loop heat pipe should be described in terms of an evaporator domain, a condenser domain, and a transition domain interconnecting the evaporator and condenser domains.

It is characteristic of a conventional closed-loop heat pipe that working fluid in liquid phase is returned from the condenser domain to the evaporator domain through the transition domain by a capillary pumping means. It is typical for the capillary pumping means to extend from the transition domain into the condenser domain to facilitate collection of liquid-phase working fluid, and into the evaporator domain to facilitate delivery of liquid-phase working fluid. The capillary pumping means could comprise, e.g., one or more channels of capillary transverse dimension extending longitudinally on an interior surface of the transition domain. Alternatively, the capillary pumping means could comprise a fine-mesh screen positioned adjacent an interior surface of the transition domain. As another alternative, the capillary pumping means could comprise an artery of capillary transverse dimension, or several such arteries, extending longitudinally through the transition domain.

A heat pipe in which an artery is used as the capillary pumping means for returning liquid-phase working fluid from the condenser domain to the evaporator domain is called an arterial heat pipe. The artery of an arterial heat pipe could be integrally formed on an interior surface of a conduit through which vapor-phase working fluid is thermodynamically driven from the evaporator domain to the condenser domain. Alternatively, the artery of an arterial heat pipe could be structurally separate from the conduit through which the vapor-phase working fluid is driven to the condenser domain, in which case the artery could be positioned either inside or outside the conduit. In particular applications, more than one such artery could be provided for an arterial heat pipe.

One end of the artery of an arterial heat pipe conventionally communicates with a condensation chamber within the condenser domain by means of a slot on an interior surface of the condenser domain defining the condensation chamber. The other end of the artery conventionally communicates with an evaporation chamber within the evaporator domain by means of a slot on an interior surface of the evaporator domain defining the evaporation chamber. The slots through which the artery communicates with the condensation chamber and the evaporation chamber are of capillary width, so that liquid-phase working fluid can be pumped by capillary action from the condensation chamber into the artery and from the artery into the evaporation chamber.

It is conventional for liquid-phase working fluid to be distributed over the surface defining the evaporation chamber by means of a channel of capillary transverse dimension formed on the surface. Such a capillary channel is preferably a closely threaded helical channel, which intersects the slot through which the artery communicates with the evaporation chamber. Alternatively, a capillary wicking structure could be positioned as a lining adjacent the surface defining the evaporation chamber, in which case a portion of the wicking structure would extend from the evaporation chamber through the slot into the artery to draw liquid-phase working fluid by capillary action from the artery into the evaporation chamber.

In certain applications, it is advantageous to provide a capability for adjusting the heat conductance of a closed-loop arterial heat pipe. A conventional technique for automatically varying the heat conductance of a heat pipe involves introducing a control gas into the condensation chamber from a control-gas reservoir, which communicates with the condensation chamber at one end of the heat pipe. The control gas is substantially noncondensible at the operating temperatures and pressures of the heat pipe. During heat pipe operation, the control gas accumulates at the end of the condensation chamber adjacent the control-gas reservoir. In the portion of the volume of the condensation chamber where the control gas accumulates, the pressure of the noncondensible control gas together with the partial pressure of vapor of the working fluid diffused in the control gas balances the pressure of the condensible vapor-phase working fluid present in the remainder of the volume of the condensation chamber. The volume of the noncondensible control gas present in the condensation chamber complements the volume of the vapor-phase working fluid present in the condensation chamber, and is therefore self-adjusting according to the heat conductance requirement of the heat pipe.

Closed-loop arterial heat pipes with control-gas reservoirs for variable heat conductance applications have encountered problems in the past due to the tendency of control gas to diffuse into the condensed working fluid, thereby forming gas bubbles in the liquid-phase working fluid flowing through the artery. Bubbles having diameters larger than the capillary transverse dimension of the slot between the artery and the evaporation chamber became trapped in the artery in the vicinity of the slot, thereby diminishing or even interrupting capillary pumping of liquid-phase working fluid from the artery through the slot into the evaporation chamber.

Formation of gas bubbles in the artery of a closed-loop arterial heat pipe can interrupt capillary pumping of liquid-phase working fluid into the evaporation chamber of a constant-conductance heat pipe, as well as a variable-conductance heat pipe. Even without the deliberate introduction of a gas into the condensation chamber of a closed-loop arterial heat pipe for controlling heat conductance, it is possible for non-condensible gases to be unintentionally or unavoidably introduced as contaminants. It is also possible for non-condensible gases to be generated within the heat pipe as a result of chemical reactions such as occur in corrosion processes.

It is imperative in certain applications to vent gas bubbles from the artery of a closed-loop arterial heat pipe, so that interruption of capillary pumping of liquid-phase working fluid from the artery into the evaporation chamber can be prevented. A bubble-venting technique used in the prior art involves enlarging the capillary dimension of the end of the artery adjacent the slot through which the artery communicates with the evaporation chamber, so that the capillary pressure on the liquid-phase working fluid and its entrained gas bubbles is lower adjacent the slot than elsewhere within the artery. Consequently, any gas bubbles in the liquid-phase working fluid in the vicinity of the slot would be pushed out of the artery through the slot into the evaporation chamber by the higher-pressure liquid-phase working fluid flowing through the artery. However, enlargement of the capillary dimension of the end of the artery adjacent the slot concomitantly reduces the pumping rate of liquid-phase working fluid through the slot, thereby decreasing the rate at which liquid-phase working fluid can be supplied to the evaporation chamber and thus degrading the heat-transport capability of the heat pipe.

Regardless of how noncondensible gas bubbles are formed in the artery of a closed-loop arterial heat pipe, the problem of venting the gas bubbles in order to prevent interruption of capillary pumping of liquid-phase working fluid from the artery into the evaporation chamber without concomitantly degrading the heat transport capability of the heat pipe has been a significant problem in the prior art.

SUMMARY OF THE INVENTION

It is an object of the present invention to provide a technique for venting noncondensible gas bubbles from the artery into the evaporation chamber of a closed-loop arterial heat pipe, without degrading the heat transport capability of the heat pipe.

A closed-loop arterial heat pipe in accordance with the present invention comprises a hollow evaporator domain having an interior surface defining an evaporation chamber, a hollow condenser domain having an interior surface defining a condensation chamber, and a transition domain interconnecting the evaporation chamber and the condensation chamber. Working fluid evaporated to vapor phase in the evaporation chamber is thermodynamically driven substantially adiabatically to the condensation chamber via a conduit through the transition domain. The vapor-phase working fluid condenses to liquid phase in the condensation chamber, and returns in liquid phase to the evaporation chamber via an artery through the transition domain. The artery is of capillary transverse dimension in order to return the liquid-phase working fluid to the evaporation chamber by capillary action. The returned liquid-phase working fluid is then available in the evaporation chamber to repeat the heat-transport cycle.

One end of the artery of a heat pipe according to the present invention communicates with the condensation chamber through a slot extending longitudinally along the surface defining the condensation chamber, and the other end of the artery communicates with the evaporation chamber through a slot extending longitudinally along the surface defining the evaporation chamber. A channel of capillary transverse cross-sectional dimension, such as a closely threaded helical channel, is formed on the surface defining the evaporation chamber. The slot on the surface of the evaporation chamber is of capillary transverse dimension and intersects the helical capillary channel. It is a feature of the present invention that the transverse dimension of the capillary channel on the surface of the evaporation chamber is smaller than the width of the slot providing communication between the artery and the evaporation chamber, and the width of the slot is smaller than any transverse dimension of the artery. Liquid-phase working fluid is thus drawn by capillary action from the artery through the slot into the capillary channel in order to wet the surface of the evaporation chamber.

In accordance with the present invention, the configuration of the artery, as well as the relative transverse dimensions of the artery, the slot and the capillary channel on the surface of the evaporation chamber, assure that a gas bubble occurring in the liquid-phase working fluid flowing through the artery is automatically vented into the evaporation chamber. The artery has a generally pyriform transverse cross-sectional configuration, which tapers from a relatively wide portion remote from the slot, through intermediate portions of progressively narrower transverse cross-sectional dimension, to a throat portion that is narrowest adjacent the slot. When a gas bubble becomes trapped in the artery, the flow of liquid-phase working fluid from the artery into the capillary channel on the surface of the evaporation chamber becomes too low to accommodate the flux of heat entering the evaporator domain. The capillary channel therefore dries out, because fresh liquid-phase working fluid cannot be supplied to the capillary channel at a rate sufficient to replenish the working fluid that is evaporated to vapor phase. When the capillary channel on the surface of the evaporation chamber is dry, heat from the heat source, which would have been absorbed by working fluid if liquid-phase working fluid has been available in the evaporation chamber, is instead conducted through the body of the evaporator domain to the vicinity of the artery, thereby increasing the temperature of the liquid-phase working fluid in the artery in the vicinity of the slot.

The increase in temperature in the artery in the vicinity of the slot increases the pressure of the liquid-phase working fluid in the throat portion of the artery over the bubble, and concomitantly increases the pressure of the gas (and also of any vapor of the working fluid that might be present) in the bubble. Eventually, the pressure of the gas in the bubble attains a value approaching without exceeding the pressure of the vapor-phase working fluid in the evaporation chamber, while the pressure of the liquid-phase working fluid over the bubble becomes sufficient to allow resumption of capillary pumping of the liquid-phase working fluid out of the artery through the slot into the capillary channel on the surface of the evaporation chamber. When the liquid-phase working fluid is driven out of the throat portion of the artery, the slot dries out and the gas bubble is vented into the evaporation chamber. The throat portion of the artery then refills with liquid-phase working fluid to the level of the slot. Liquid-phase working fluid is then drawn by capillary action from the artery through the slot into the capillary channel on the surface of the evaporation chamber.

When trapped gas bubbles again interrupt the capillary pumping of liquid-phase working fluid from the artery into the evaporation chamber of a closed-loop arterial heat pipe according to the present invention, the artery again becomes pressurized due to the conductive transfer of heat through the evaporator domain to the artery. Pressurization of the bubbles in the artery to a value approaching the pressure of the vapor-phase working fluid in the evaporation chamber again causes the contents of the bubbles to be vented automatically into the evaporation chamber, which enables liquid-phase working fluid to again refill the artery to the level of the slot on the surface defining the evaporation chamber. Liquid-phase working fluid is again pumped into the capillary channel on the surface of the evaporation chamber, and becomes available to restore normal operation of the heat pipe. Thus, a closed-loop arterial heat pipe according to the present invention is self-venting whenever the heat transport process is interrupted by the occurrence of gas bubbles in the artery.

BEST MODE OF CARRYING OUT THE INVENTION

Figure 1:
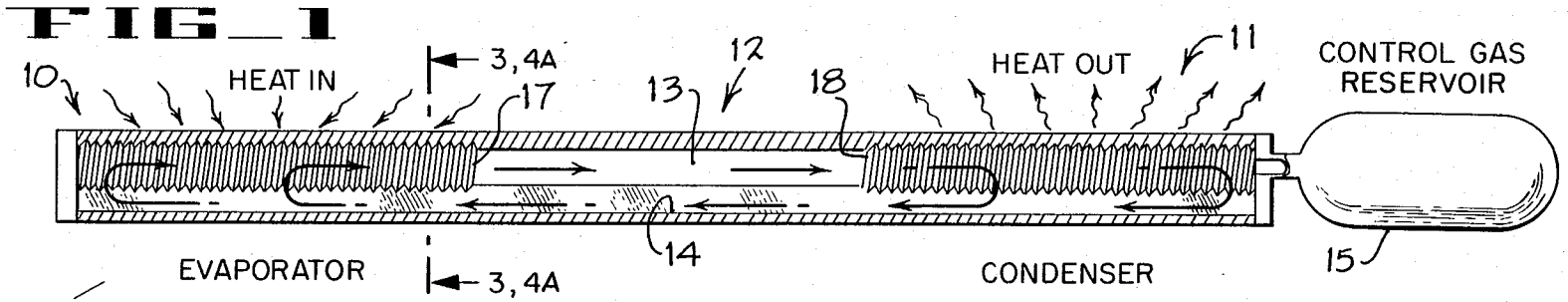
FIG. 1 is a schematic view in longitudinal cross section of a closed-loop arterial heat pipe according to the present invention.
Figure 3:
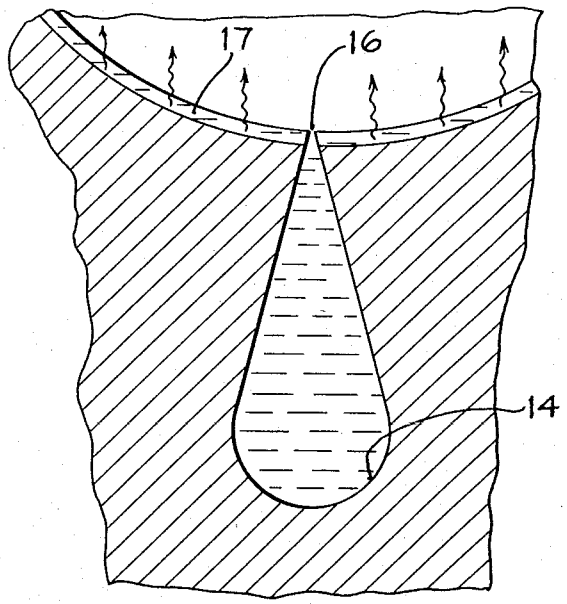
FIG. 3 is a fragmentary transverse cross-sectional view along line 3—3 of FIG. 1 illustrating the artery filled with liquid-phase working fluid, and indicating liquid-phase working fluid being evaporated to vapor phase from the helical channel on the interior surface of the evaporation chamber of the heat pipe.

A closed-loop arterial heat pipe according to the present invention, as illustrated schematically in FIG. 1, comprises an evaporator domain 10 and a condenser domain 11 interconnected by a transition domain 12. The evaporator domain 10 is configured according to the particular application for exposure to a heat source, and the condenser domain 11 is also configured according to the particular application for exposure to a heat sink, where the heat sink is at a lower temperature than the heat source. A working fluid, which evaporates to vapor phase at the temperature of the evaporator domain 10 and which condenses to liquid phase at the temperature of the condenser domain 11, circulates between an evaporation chamber within the evaporator domain 10 and a condensation chamber within the condenser domain 11 via a vapor-phase transport conduit 13 and a liquid-phase return artery 14 in the transition domain 12. In a particular application, the evaporator domain 10 and the condenser domain 11 could be separate structural entities distinct from the interconnecting transition domain 12. However, for the purpose of illustration, the heat pipe of FIG. 1 is shown as an integral structure of elongate configuration in which the evaporation chamber and the condensation chamber are located at opposite ends of the conduit 13.

In operation, a flux of heat from the heat source is conducted through a wall of the evaporator domain 10 into liquid-phase working fluid present in the evaporation chamber of the heat pipe. The liquid-phase working fluid is evaporated in the evaporation chamber to vapor phase, and the evaporated working fluid absorbs additional heat conducted through the wall of the evaporator domain 10. Due to the temperature difference between the heat source and the heat sink, the evaporated working fluid with its absorbed heat load is driven from the evaporator domain 10 substantially adiabatically via the conduit 13 to the condensation chamber within the condenser domain 11. The heat load of the vapor-phase working fluid is rejected by condensation of the working fluid to liquid phase in the condensation chamber. The rejected heat is conducted through a wall of the condenser domain 11 either directly to the heat sink, or to means for radiating the rejected heat to the heat sink. The condensed working fluid is then returned in liquid phase from the condenser domain 11 to the evaporator domain 10 by capillary action via the artery 14.

In order to provide a capability for varying the heat conductance of the heat pipe of the present invention, a control-gas reservoir 15 can be connected as shown in FIG. 1 in communication with the condensation chamber of the condenser domain 11. A control gas that is substantially noncondensible at the operating temperatures and pressures of the heat pipe is contained in the control-gas reservoir 15. Ordinarily, for a typical control gas, the volume of the control-gas reservoir 15 is much larger than the volume of the condensation chamber. The control gas accumulates at the end of the condensation chamber adjacent the control-gas reservoir 15 during operation of the heat pipe, so that the pressure of the noncondensible control gas together with the partial pressure of vapor of the working fluid diffused in the control gas balances the pressure of the condensible vapor-phase working fluid present in the remainder of the volume of the condensation chamber. The volume of the noncondensible control gas in the condensation chamber varies inversely with the volume of the condensible (but uncondensed) vapor-phase working fluid present in the condensation chamber, and is therefore self-adjusting according to the rate of condensation of the vapor-phase working fluid. The volume of the control gas in the condensation chamber determines the effective length of the condensation chamber, and thereby determines the heat conductance of the heat pipe for any particular set of thermal conditions.

In principle, the artery 14 could be a distinct tubular structure separate from the conduit 13. However, in the embodiment illustrated in FIG. 1, the artery 14 is not a structurally distinct entity, but rather is shown as a groove of capillary transverse dimension formed on an interior surface portion of the conduit 13. One end of the artery 14 communicates with the condensation chamber of the condenser domain 11 through a slot extending longitudinally on an interior surface of the condenser domain 11 defining the condensation chamber. Condensed working fluid is collected from the condensation chamber through that slot. The other end of the artery 14 communicates with the evaporation chamber of the evaporator domain 10 through a slot (shown as slot 16 in FIG. 2) extending longitudinally on an interior surface of the evaporator domain 10 defining the evaporator chamber. Liquid-phase working fluid is delivered from the artery 14 into the evaporation chamber through the slot 16.

The artery 14 could communicate with the condensation chamber and the evaporation chamber at extreme opposite ends of a single slot extending from one end to the other of the heat pipe, in which case the conduit 13 would be in communication with the artery 14 throughout the transition domain 12. However, even where the artery 14 is open to the conduit 13 throughout the transition domain 12, no significant amount of liquid-phase working fluid would ordinarily pass from the artery 14 into the conduit 13 because of the predominant effect of the capillary pumping of liquid-phase working fluid through from the artery 14 toward the evaporation chamber. Also, no significant amount of vapor-phase working fluid would ordinarily pass from the conduit 13 into the artery 14 because of the predominant effect of the thermodynamic forces driving the vapor-phase working fluid through the conduit 13 toward the condensation chamber. In applications where it would be desirable to preclude communication between the conduit 13 and the artery 14, the artery 14 could be configured as a tunnel outside the conduit 13, or as a tunnel through the conduit 13 but having a wall that is impervious to the vapor-phase contents of the conduit 13.

Figure 2:
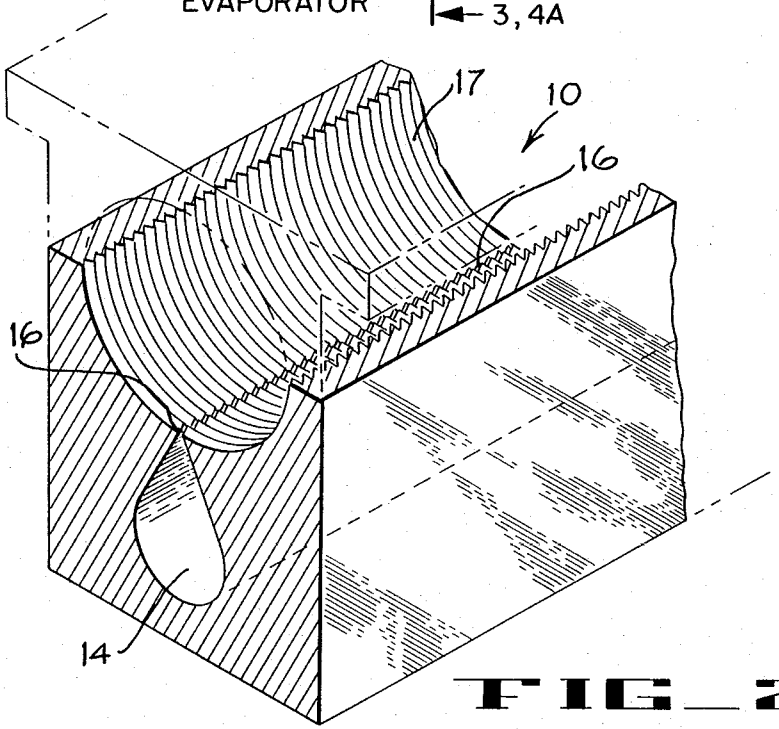
FIG. 2 is a perspective view showing cross sections along two mutually orthogonal planes through the evaporator domain of the heat pipe of FIG. 1.

As shown in detail in FIG. 2, the artery 14 (or at least the end of the artery 14 in communication with the evaporation chamber) has a generally pyriform transverse cross-sectional configuration, which tapers from a relatively wide portion remote from the slot 16, through intermediate portions where the transverse dimension becomes progressively narrower, to a throat portion that is narrowest immediately adjacent the slot 16. The transverse cross-sectional dimension at the widest portion of the artery 14 is smaller than the transverse cross-sectional dimension of the vapor-phase conduit 13, which insures that liquid-phase working fluid preferentially fills the artery 14 when the artery 14 is oriented predominantely horizontally below the conduit 13 in a terrestrial or other high-gravity application. In a reduced-gravity application in extraterrestrial space, liquid-phase working fluid would preferentially fill the artery 14 regardless of the orientation of the artery 14. If a gas bubble appears in the artery 14, the progressive narrowing of the transverse cross-sectional dimension of the artery 14 toward the slot 16 insures that liquid-phase working fluid flowing through the artery 14 preferentially occupies the throat portion adjacent the slot 16 in a reduced-gravity application.

As also shown in detail in FIG. 2, a threaded capillary channel 17 is helically formed on the interior surface defining the evaporation chamber of the evaporator domain 10. The threads of the capillary channel 17 intersect the slot 16, and the tranverse dimension of each thread is smaller than the width of the slot 16. Liquid-phase working fluid by capillary action filling the artery 14 to the level of the slot 16 can thereby be pumped from the artery 14 through the slot 16 into the channel 17 by capillary action. The capillary channel 17 is closely threaded to distribute liquid-phase working fluid by capillary action over substantially the entire surface of the evaporation chamber. It is not necessary that the capillary channel 17 be helical for the practice of the present invention. Thus, e.g., closely spaced circular grooves of capillary dimension could be provided on the surface of the evaporation chamber instead of the helical channel 17. However, a helical configuration for the capillary channel 17 is generally easier than other configurations to fabricate.

It is fundamental to the present invention that, as mentioned above, the transverse cross-sectional dimension of the artery 14 tapers from a relatively wide portion remote from the slot 16, through intermediate portions of progressively narrower transverse cross-sectional dimension, to a throat portion that is narrowest adjacent the slot 16. It is also fundamental to the present invention that the width of the slot 16 is no wider than the throat portion of the artery 14, and that the threads of the capillary channel 17 have a narrower transverse dimension than the width of the slot 16. In this way, the surface of the evaporation chamber is continuously wetted by a fresh supply of liquid-phase working fluid drawn by capillary action from the artery 14 to replenish the liquid-phase working fluid that is evaporated from the capillary channel 17 by the heat flux entering the evaporator domain 10. Capillary pumping, or wicking, of liquid-phase working fluid from the artery 14 into the capillary channel 17 can occur uninterruptedly as long as the liquid-phase working fluid flowing through the artery 14 fills the throat portion of the artery 14 to the level of the slot 16, and as long as the pressure of the liquid-phase working fluid flowing through the artery 14 does not become excessively smaller than the pressure of the vapor-phase working fluid in the evaporation chamber.

It is ordinarily desirable, as illustrated in FIG. 1, for a closely threaded channel 18, also of capillary transverse dimension, to be formed (preferably as a helix) on an interior surface defining the condensation chamber of the condenser domain 11. In this embodiment, the threads of the capillary channel 18 intersect a slot through which the artery 14 communicates with the condensation chamber, thereby enabling capillary pumping of the condensed working fluid from the condensation chamber into the artery 14. It is possible, however, for another type of capillary structure to be used in the condensation chamber to pump condensed working fluid into the artery 14. For example, a screen whose mesh is of capillary dimension could be positioned adjacent the interior surface defining the condensation chamber and could extend to the edges of the slot through which the condensed working fluid is pumped into the artery 14.

Pumping of liquid-phase working fluid from the artery 14 through the slot 16 into the evaporation chamber is caused by the capillary pressure gradient in the throat portion of the artery 14. The flow rate of liquid-phase working fluid through the slot 16 into the evaporation chamber is equal to the heat transfer rate of the heat pipe divided by the enthalpy needed to change the liquid-phase working fluid to vapor phase in the evaporation chamber. As long as the sum of all the pressure gradients throughout the heat pipe (which enable the working fluid to circulate from the evaporation chamber through the conduit 13 to the condensation chamber in vapor phase, and from the condensation chamber through the artery 14 back to the evaporation chamber in liquid phase) remains less than the capillary pressure gradient in the throat portion of the artery 14, the pumping of liquid-phase working fluid out of the artery 14 through the slot 16 continues without interruption.

If there is no diffusion of control gas (or any other noncondensable gas) into the liquid-phase working fluid flowing through the artery 14, the liquid-phase working fluid fills the artery 14 to the level of the slot 16. However, noncondensible gas sometimes does diffuse into the liquid-phase working fluid. Such gas could be, e.g., control gas, or a contaminant gas present in the control gas, or a gaseous product of corrosion processes occurring within the heat pipe. If a noncondensible gas from whatever source does diffuse into the liquid-phase working fluid, bubbles of the gas appear in the artery 14. In general, a noncondensible gas bubble in the liquid-phase working fluid flowing through the artery 14 assumes a spherical shape. Any bubble with a diameter larger than the transverse dimension of the throat portion of the artery 14 cannot pass through the throat portion to the slot 16, and therefore lodges in the intermediate portion of the artery 14 adjacent the throat portion.

When a gas bubble becomes trapped adjacent the throat portion of the artery 14 operating at near maximum circulation rate for the working fluid, the flow rate of liquid-phase working fluid through the slot 16 into the capillary channel 17 on the surface of the evaporation chamber decreases, or stops completely, depending upon the size of the bubble. Even if the bubble merely decreases the flow of liquid-phase working fluid through the slot 16 into the capillary channel 17, the channel 17 eventually dries out because the supply of fresh liquid-phase working fluid delivered to the channel 17 is inadequate to replenish the liquid-phase working fluid evaporated to vapor phase by heat entering the evaporation chamber from the heat source. As the capillary channel 17 dries out, the liquid-phase working fluid in the throat portion of the artery 14 forms a liquid seal over the bubble. The liquid seal prevents the contents of the bubble from venting through slot 16 into the interior of the evaporation chamber, and the bubble displaces liquid-phase working fluid from the throat portion of the artery 14. The presence of a gas bubble adjacent the throat portion of the artery 14 causes a reduction in the capillary pressure gradient in the throat portion, which diminishes or halts the pumping of liquid-phase working fluid from the artery 14 into the evaporation chamber. Specifically, the presence of a bubble adjacent the throat portion of the artery 14 changes the capillary pressure gradient in the throat portion (for axial pumping of liquid-phase working fluid from the condenser domain 11 to the evaporator domain 10) from a value determined predominantly by the width of the slot 16 to a smaller value determined predominantly by the volume of the trapped bubble.

In accordance with the present invention, the pyriform configuration of the artery 14 in conjunction with the specified relation between the dimensions of the slot 16 and the capillary channel 17 causes any liquid seal forming over a gas bubble in the artery 14 to dry up, so that the contents of the gas bubble can vent automatically into the interior of the evaporation chamber. The sequence of occurrences which result in the automatic venting of a gas bubble into the evaporation chamber of a heat pipe according to the present invention is illustrated in FIG. 4, which comprises the sequential views of FIGS. 4A, 4B, 4C and 4D.

Figure 4A:
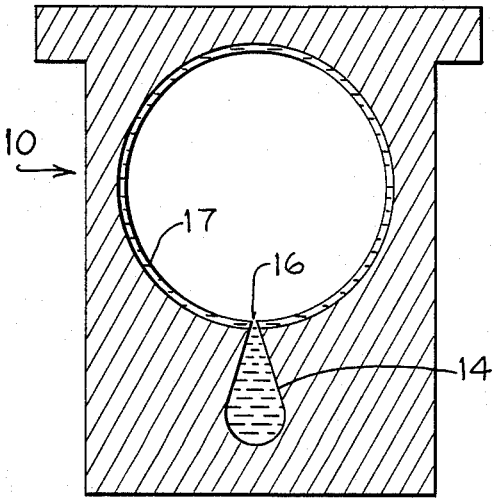
FIG. 4 (comprising FIGS. 4A, 4B, 4C and 4D) is a transverse cross-sectional view along line 4—4 of FIG. 1 illustrating four successive stages in the venting of a gas bubble from the artery into the evaporation chamber of the heat pipe.

In FIG. 4A, normal operation of the heat pipe (i.e., operation without any gas bubble in the artery 14) is illustrated. Liquid-phase working fluid fills the artery 14 to the level of the slot 16, and is pumped by capillary action from the artery 14 through the slot 16 into the helical capillary channel 17 so as to fill the channel 17 around the interior surface defining the evaporation chamber of the evaporator domain 10. As liquid-phase working fluid is evaporated from the channel 17 by the flux of heat entering the evaporator domain 10, a replenishing supply of liquid-phase working fluid is delivered from the artery 14 into the channel 17 by capillary action. The geometrical parameters of the heat pipe (e.g., the length of the heat pipe, the volume of the vapor-phase transport conduit 13, the volume of the liquid-phase return artery 14, and the width of the slot 16) are selected to provide the heat conductance required to satisfy the heat load of the particular application. In general, there is no unique set of geometrical parameters required for any particular application. However, in order to optimize the heat conductance of the heat pipe, the geometrical parameters in combination must be such that the capillary channel 17 is completely wetted by liquid-phase working fluid during normal operation.

For a given set of geometrical parameters, a closed-loop arterial heat pipe according to the present invention has a maximum heat transport rate, which is a measure of the ability of the heat pipe to transport heat from the evaporator domain 10 to the condenser domain 11. The maximum heat transport rate depends upon the rate at which liquid-phase working fluid can be returned from the condensation chamber of the condenser domain 11 via the artery 14 to the capillary channel 17 on the surface defining the evaporation chamber of the evaporator domain 10. The heat pipe can function effectively only as long as the rate at which liquid-phase working fluid is pumped into the capillary channel 17 is sufficient to provide an adequate supply of liquid-phase working fluid to accommodate the flux of heat entering the evaporation chamber. If the capillary pumping rate becomes inadequate to accommodate the heat flux entering the evaporation chamber, evaporation of liquid-phase working fluid occurs faster than a replenishing supply of liquid-phase working fluid can be provided, and the heat pipe fails.

Figure 4B:
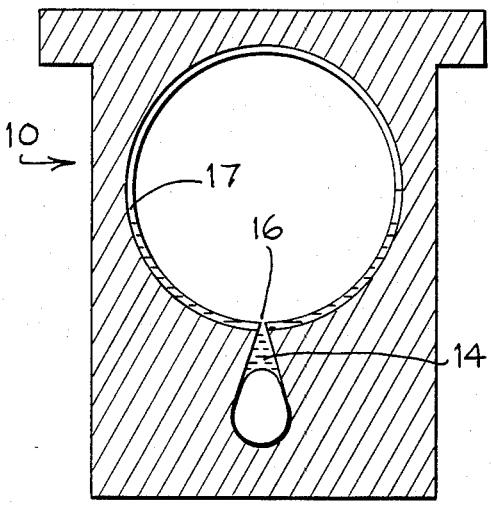

For a closed-loop arterial heat pipe whose geometrical parameters are designed to provide an adequate capillary pumping rate for liquid-phase working fluid into the capillary channel 17 to accommodate a specified heat flux, a primary cause of heat pipe failure would be the interruption of capillary pumping due to the occurrence of gas bubbles in the artery 14. In FIG. 4B, a bubble of noncondensible gas is shown occurring in the artery 14. The bubble decreases the effective capillary pumping pressure available for axial transport of the liquid-phase working fluid from the condenser domain 11 to the evaporator domain 10, and consequently prevents liquid-phase working fluid from being pumped into the capillary channel 17 at a rate sufficient to meet the heat conductance requirement of the heat pipe. The heat flux passing into the evaporator domain 10 therefore causes the capillary channel 17 to dry faster than a replenishing supply of liquid-phase working fluid can be delivered to the capillary channel 17. In the view shown in FIG. 4B, the upper portion of the interior surface of the evaporation chamber (i.e., the portion of the threaded capillary channel 17 furthest away from the slot 16) has already become dry, thereby reducing the thermal conductance of the heat pipe.

As heat from the heat source continues to enter the evaporation chamber without replenishment of liquid-phase working fluid in the evaporation chamber, heat that would have been absorbed by a replenished supply of liquid-phase working fluid is instead conducted through the wall of the evaporator domain 10 into the artery 14. The temperature (and therefore the pressure) of the liquid-phase working fluid forming the liquid seal in the throat portion of the artery 14, as well as the temperature (and therefore the pressure) of the gas in the trapped bubble, correspondingly rise. The trapped gas bubble, which cannot penetrate the liquid seal, tends to expand longitudinally within the intermediate portion of the artery 14 so as to assume an elongate cylindrical shape under the liquid seal parallel to the slot 16. Eventually, the pressure of the liquid seal and also the pressure of the gas in the trapped bubble approach, but do not exceed, the pressure of the vapor-phase working fluid in the evaporation chamber.

Figure 4C:
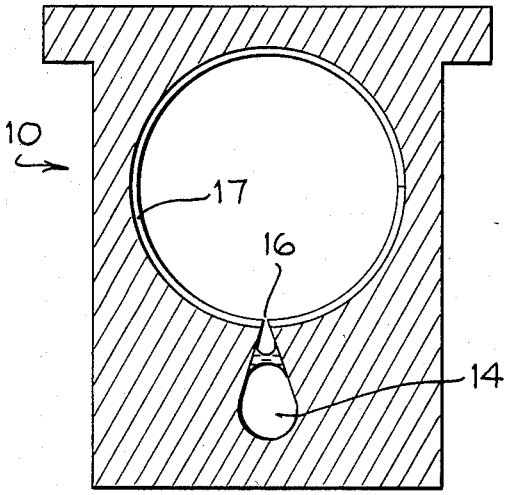
Figure 4D:
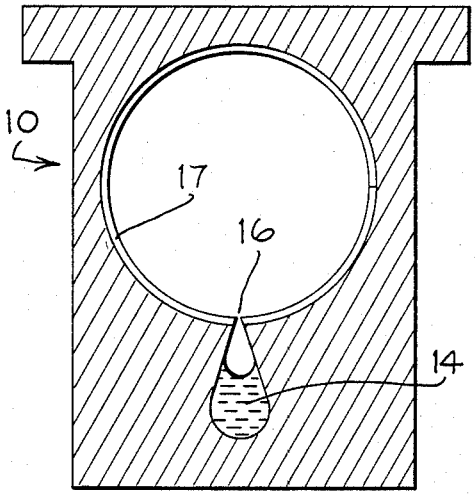

In FIG. 4C, the capillary channel 17 is shown after having become completely dry due to the continued unavailability of liquid-phase working fluid to replenish the liquid-phase working fluid that has been evaporated. Furthermore, drying has occurred across the slot 16 down into the throat portion of the artery 14, leaving only a small amount of liquid-phase working fluid over the bubble in the intermediate portion of the artery 14. As soon as the pressure difference between the vapor-phase working fluid in the evaporation chamber and the liquid-phase working fluid in the throat portion of the artery 14 reaches a value equal to the maximum capillary pressure gradient that can be maintained in the slot 16, the liquid-phase working fluid over the bubble can be pumped by capillary action toward the slot 16, and then through the slot 16 into the capillary channel 17 on the surface of the evaporation chamber. The gas in the bubble then has unimpeded entry into the throat portion of the artery 14 from whence it vents through the slot 16 into the interior of the evaporation chamber. As shown in FIG. 4D, liquid-phase working fluid then begins to refill the artery 14 to the level of the slot 16, and a replenishing supply of liquid-phase working fluid again becomes available to be pumped by capillary action from the throat portion of the artery 14 through the slot 16 into the capillary channel 17.

In a zero-gravity environment, there would be no tendency for gas bubbles in the liquid-phase working fluid to rise in any particular direction within the artery 14 due to the difference in density between the gas and the liquid-phase working fluid. Nevertheless, the liquid-phase working fluid preferentially migrates toward the throat portion of the artery 14 because of capillary action resulting from the pyriform cross-sectional configuration of the artery 14. This feature insures that gas bubbles present in the liquid-phase working fluid in the artery 14, upon being pressurized by heat conducted through the wall of the evaporator domain 10, are automatically vented through the throat portion of the artery 14 and through the slot 16 into the evaporation chamber independently of gravity as the meniscus over the bubble ruptures due to removal of the liquid seal from the throat portion of the artery 14. Thus, an arterial heat pipe according to the present invention is particularly useful in extraterrestrial applications.

A particular embodiment of the present invention has been described and illustrated herein, although various modifications and alterations to meet the requirements of specific applications would also be apparent to workers skilled in the art upon perusal of the foregoing description and the accompanying drawing. Such modifications and alterations would likewise be within the scope of the invention, which is defined by the following claims and their equivalents.

I claim:

1. A closed-loop arterial heat pipe comprising:

(a) an evaporator domain having an internal surface defining an evaporation chamber in which a working fluid in liquid phase evaporates to vapor phase by absorbing heat from a heat source;

(b) a condenser domain in which said working fluid in vapor phase condenses to liquid phase by rejecting heat to a heat sink; and (c) a transition domain including:

(i) a conduit through which said working fluid is thermodynamically driven in vapor phase from said evaporator domain to said condenser domain, and (ii) an artery through which said working fluid is returned in liquid phase from said condenser domain to said evaporator domain by capillary action, said artery communicating with said evaporation chamber through an aperture in said internal surface of said evaporation chamber; said artery being of generally pyriform transverse cross-sectional configuration, a wide portion of said artery having a relatively large transverse dimension remote from said aperture, intermediate portions of said artery having progressively narrower transverse dimensions toward said aperture, and a throat portion of said artery having a narrowest transverse dimension adjacent said aperture; said aperture having a transverse dimension smaller than said narrowest transverse dimension of said artery; said internal surface of said evaporation chamber having a capillary channel for distributing said working fluid in liquid phase within said evaporation chamber; said capillary channel intersecting said aperture in said internal surface; said capillary channel having a transverse dimension smaller than said transverse dimension of said aperture.

2. The heat pipe of claim 1 wherein said capillary channel is a closely threaded helical channel on the surface of said evaporation chamber.

3. The heat pipe of claim 2 wherein said aperture through which said artery communicates with said evaporation chamber is an elongate slot, said closely threaded helical channel intersecting said slot.

4. The heat pipe of claim 1 wherein said condenser domain has an internal surface defining a condensation chamber; and wherein said artery communicates with said condensation chamber through an aperture in said internal surface of said condensation chamber.

5. The heat pipe of claim 4 further comprising a gas reservoir in communication with said condenser domain, said gas reservoir admitting a substantially non-condensible gas into said condensation chamber of said condenser domain to control heat conductance of said heat pipe.

6. A closed-loop arterial heat pipe for transporting heat from a heat source to a heak sink, said heat pipe comprising:

(a) an evaporator domain, which includes:
(i) an exterior surface configured to intercept a flux of heat from said heat source, and
(ii) an interior surface defining an evaporation chamber, said interior surface of said evaporator domain being configured to pump working fluid in liquid phase by capillary action into said evaporation chamber through an aperture in said interior surface of said evaporator domain, said evaporator domain being structured so that, when said working fluid in liquid phase is being pumped into said evaporation chamber, a major part of said flux of heat intercepted by said exterior surface of said evaporator domain is conducted to said evaporation chamber for evaporating said liquid-phase working fluid to vapor phase;

(b) a condenser domain, which includes:
(i) an exterior surface configured to reject heat to said heat sink, and
(ii) an interior surface defining a condensation chamber in which vapor-phase working fluid can condense to liquid phase, said interior surface of said condenser domain being configured to enable working fluid in liquid phase to exit from said condensation chamber through an aperture in said interior surface of said condenser domain; and (c) a transition domain interconnecting said evaporation chamber and said condensation chamber, said transition domain defining;
(i) a conduit through which vapor-phaase working fluid can travel substantially adiabatically from said evaporation chamber to said condensation chamber, and
(ii) an artery into which liquid-phase working fluid exiting from said condensation chamber through said aperture in said interior surface of said condenser domain can pass, and from which liquid-phase working fluid can be pumped by capillary action into said evaporation chamber through said aperture in said interior surface of said evaporator domain; said artery having a transverse cross section that converges from a wide portion having a relatively large transverse dimension remote from said aperture in said interior surface of said evaporator domain, through intermediate portions having progressively narrower transverse dimensions, to a throat portion having a narrowest transverse dimension adjacent said aperture in said interior surface of said evaporator domain, said aperture in said interior surface of said evaporator domain having a transverse dimension that is smaller than said narrowest transverse dimension of said throat portion of said artery;

said artery being configured so that, upon occurrence of a gas bubble of sufficient size in said liquid-phase working fluid to cause interruption of capillary pumping of said liquid-phase working fluid from said artery into said evaporation chamber, heat conducted through said evaporator domain to said artery increases temperature in said liquid-phase working fluid adjacent the bubble sufficiently to vaporize liquid-phase working fluid between the bubble and said aperture in said interior surface of said evaporator domain, and concomitantly increases pressure in the bubble to a value approaching without exceeding pressure in said evaporation chamber, thereby allowing resumption of the pumping of capillary action of liquid-phase working fluid adjacent the bubble from said artery into said evaporation chamber.

7. The heat pipe of claim 6 further comprising a gas reservoir in communication with said condenser domain, said gas reservoir admitting a substantially non-condensible gas into said condensation chamber for controlling heat conductance of said heat pipe.

8. The heat pipe of claim 6 wherein said interior surface of said evaporator domain is configured to enable liquid-phase working fluid to be retained adjacent said interior surface of said evaporator domain until evaporated by said flux of heat.

9. The heat pipe of claim 8 wherein said interior surface of said evaporator domain has a channel of capillary transverse dimension thereon for receiving liquid-phase working fluid pumped by capillary action into said evaporation chamber.

10. The heat pipe of claim 9 wherein said interior surface of said evaporator domain is generally cylindrical, and wherein said channel of capillary transverse dimension extends generally helically along said cylindrical interior surface of said evaporator domain.

11. The heat pipe of claim 6 wherein said interior surface of said condenser domain has a channel for collecting working fluid condensed to liquid phase in said condensation chamber, said channel communicating with said artery through said aperture in said interior surface of said condenser domain, said channel being dimensioned with respect to said artery to enable pumping of liquid-phase working fluid from said channel into said artery by capillary action.

12. The heat pipe of claim 6 wherein said evaporation chamber is elongate, and wherein said artery extends generally longitudinally with respect to said evaporation chamber, said aperture in said interior surface of said evaporator domain being a slot through which working fluid is liquid phase can be pumped by capillary action from said artery into said evaporation chamber.

13. The heat pipe of claim 12 wherein said evaporation chamber is generally cylindrical, and wherein said slot extends along said interior surface of said evaporator domain generally longitudinally with respect to said evaporation chamber.

14. The heat pipe of claim 13 wherein said interior surface of said evaporator domain has a channel of capillary transverse cross-sectional dimension, said channel extending generally helically along said interior surface of said evaporator domain, said artery communicating with said helical channel through said slot so that liquid-phase working fluid can be pumped by capillary action from said artery into said helical channel.

15. The heat pipe of claim 11 wherein said condensation chamber is elongate, and wherein said artery extends generally longitudinally with respect to said condensation chamber, said aperture in said interior surface of said condenser domain being a slot through which working fluid in liquid phase can pass from said evaporation chamber into said artery.

16. The heat pipe of claim 13 wherein said artery has a generally pyriform transverse cross-sectional configuration that converges to a throat portion adjacent said slot.

17. A closed-loop arterial heat pipe comprising:
(a) an evaporator domain in which a working fluid can absorb heat from a heat source, an interior surface of said evaporator domain having a capillary channel formed thereon;

(b) a condenser domain in which said working fluid can reject heat to a heat sink; and (c) a transition domain interconnecting said evaporator domain and said condenser domain, said transition domain defining:

(i) a conduit through which said working fluid, after having been evaporated to vapor phase in said evaporator domain, can travel substantially adiabatically to said condenser domain for condensation to liquid phase; and (ii) an artery through which said working fluid, after having been condensed to liquid phase in said condenser domain, can be returned to said evaporator domain by capillary action; said artery communicating with said capillary channel on said interior surface of said evaporator domain through an elongate slot intersecting said capillary channel, said artery having a generally pyriform transverse cross-sectional configuration that converges to a throat portion adjacent said slot, said slot having a transverse dimension that is smaller than any transverse cross-sectional dimension of said artery and larger than any transverse cross-sectional dimension of said capillary channel on said interior surface of said evaporator domain.

18. The heat pipe of claim 17 further comprising a gas reservoir in communication with said condenser domain, said gas reservoir admitting a substantially noncondensible gas into said condenser domain for controllably varying heat conductance of said heat pipe.

19. The heat pipe of claim 17 wherein said interior surface of said evaporator domain is generally cylindrical, and wherein said capillary channel on said interior surface of said evaporator domain is generally helical.

* * * * *